US010881976B2

(12) United States Patent
Bobrikov

(10) Patent No.: US 10,881,976 B2
(45) Date of Patent: Jan. 5, 2021

(54) CONNECTING ELEMENT OF A TOY CONSTRUCTION KIT

(71) Applicant: Aleksandr Borisovich Bobrikov, Norilsk (RU)

(72) Inventor: Aleksandr Borisovich Bobrikov, Norilsk (RU)

( * ) Notice: Subject to any disclaimer, the term of this patent is extended or adjusted under 35 U.S.C. 154(b) by 0 days.

(21) Appl. No.: 16/761,393

(22) PCT Filed: Dec. 5, 2018

(86) PCT No.: PCT/RU2018/000783
§ 371 (c)(1),
(2) Date: May 4, 2020

(87) PCT Pub. No.: WO2019/117754
PCT Pub. Date: Jun. 20, 2019

(65) Prior Publication Data

US 2020/0346126 A1 Nov. 5, 2020

(30) Foreign Application Priority Data

Dec. 13, 2017 (RU) ..... 2017143744

(51) Int. Cl.
*A63H 3/04* (2006.01)
*A63H 33/04* (2006.01)
*A63H 33/26* (2006.01)

(52) U.S. Cl.
CPC ..... *A63H 33/046* (2013.01); *A63H 33/26* (2013.01)

(58) Field of Classification Search
CPC ..... A63H 33/046; A63H 33/26
USPC ..... 446/92, 129
See application file for complete search history.

(56) References Cited

U.S. PATENT DOCUMENTS 2,363,914 A * 11/1944 Wakefield ..... A63H 3/52 446/92
2,653,415 A * 9/1953 Becker ..... A63H 3/46 446/376
3,372,443 A * 3/1968 Daddona, Jr. ..... A41F 1/002 24/303
3,375,604 A * 4/1968 Alonso ..... A63H 3/16 446/92

(Continued)

FOREIGN PATENT DOCUMENTS

RU 17446 U1 4/2001
RU 2310493 C2 11/2007
RU 164271 U1 8/2016

*Primary Examiner* — Nini F Legesse
(74) *Attorney, Agent, or Firm* — Nadya Reingand; Yan Hankin

(57) ABSTRACT

The invention relates to fastening elements of a toy construction kit and can be used for creating toy construction kit elements which are connected by means of connecting elements. A connecting element of a toy construction kit consists of two parts, a receiving part and a removable part, which, when brought together, fasten together under the effect of magnetic forces such as to be disconnectable and rotatable about the coupling point by 360°. The receiving part consists of a disc, a collar, and a neodymium magnet in the form of a truncated cone-shaped collar, which have different diameters and are fastened to one another. The removable part consists of a disc with a through opening, a collar, and a neodymium magnet, which have different diameters, and a metal rod, which are fastened to one another.

1 Claim, 3 Drawing Sheets

(56) References Cited

U.S. PATENT DOCUMENTS

| | | | | |
|---|---|---|---|---|
| 4,736,494 | A * | 4/1988 | Marchesi | A41F 1/002 24/303 |
| 5,071,355 | A | 12/1991 | Schmitz et al. | |
| 5,330,258 | A * | 7/1994 | Hoshoya | B60T 8/341 303/113.2 |
| 6,892,428 | B2 * | 5/2005 | Reiter | A41F 1/002 24/303 |
| 7,144,179 | B2 * | 12/2006 | Varner | A47F 8/00 403/24 |
| 8,206,459 | B1 * | 6/2012 | Lock | A61F 2/78 623/33 |

* cited by examiner

CONNECTING ELEMENT OF A TOY CONSTRUCTION KIT

CROSS-REFERENCE TO RELATED APPLICATIONS

This international patent application is a National stage application from PCT application PCT/RU2018/000783 filed Dec. 5, 2018 which claims priority to Russian patent application RU2017143744 filed Dec. 13, 2017.

FIELD OF INVENTION

The invention relates to fastening elements of a toy construction kit and can be used to create volume closed elements of the toy construction kit, which have different shapes, dimensions and colors and are configured to be connected to each other by means of connecting elements. The invention is intended to develop preschool- and school-age children, fine motor skills, spatial, logical and creative thinking, attention and diligence.

BACKGROUND

There are different known construction kits, each representing a set of elements having fasteners for receiving construction kit members to form different spatial figures.

Inventor's certificate SU 1623595 (dated 11 May 1988 and published 30 Jan. 1991 in Bulletin No. 4, IPC A44B 19/00) discloses a fastener consisting of an outer part and an inner part both having mating magnetic elements, the outer part having a fixing rod on a mating surface of the mating magnetic elements, the fixing rod having an annular groove, and the inner part having a hole for passing the fixing rod therethrough. The magnetic element of the outer part is configured as a cone arranged on the mating surface, and the fixing rod has a rounded-vertex cone and is arranged at a vertex of the magnetic element. The magnetic element of the inner part has a conical cavity on the side of the mating surface and a cylindrical cavity exposed on the side opposite to the mating surface. The hole for passing the fixing rod therethrough is made at a vertex of the conical cavity, and the inner part further comprises a lock spring mounted into the cylindrical cavity and a sub-flange disk having a recess in its center and mounted above the cylindrical cavity. The outer part is provided with a guide element configured as a button, and the inner part is provided with a cover bar configured as a disk of sheet material with a protrusion in its center.

The drawback of the above-described fastener is its structural complexity.

Patent RU 2448754 (dated 13 Jul. 2009 and published 27 Apr. 2012 in Bulletin No. 12, IPC A63H 33/04, A63H 33/00) discloses a construction kit of a stuffed toy, which consists of a set of modular elements equipped with means for connecting the elements together. The modular elements of the construction kit are made of fabric or other flexible material in the form of geometric shapes or forms with fixation elements fixed on their surface. The fixation elements are configured to temporarily hold together the connected points or areas of the surface of the modular elements. In the meantime, the fixation elements are selected and arranged on the surface of each modular element in such a way that its original form can be reversibly modified, exposed to transformation by bending, folding, twisting or wrenching with subsequent fixation of the modified form using these connecting means. The modular elements are made of one flexible material, for example, fabric, knitted fabric, leather, fur, felt, rubber or a combination of different flexible materials, for example, fabric and felt, leather and fur. As means for fixing the modified form of the modular elements and connecting the modular elements together, similar connecting means are used, for example, including pieces of a Velcro fastener, halves of buttons, button-loop, button-slot, hook-loop connections, ribbon- and/or string-shaped laces tied to each other in a knot or bowknot, magnets, or a combination of different connecting means—for example, there may be buttons, slots, hooks and loops on the surface of one modular element at the same time. The number of fixing means present on the surface of the modular elements can be the same or different. Means for connecting the modular elements together are arranged in the same or different manner on the similarly shaped members of the construction kit. For each connecting means present on the surface of the modular element, there is a mated one—for example, there are four loops and four buttons on the surface of the modular element; or numbers of mating connecting means can be different—for example, there are six loops and only four buttons on the surface of the modular element. The means for fixing the modified form of the modular element or connecting the modular elements together occupy either a surface portion of the modular element, for example, pieces of a Velcro fastener arranged at angles of a square member, or the whole surface of the modular element, for example, if the surface of the modular element is fully made of the Velcro fastener. The modular elements are made as a one-layer, two-layer or multi-layer flat geometrical shapes, and the two-layer and multi-layer modular elements can be both closed and unclosed. The modular elements are made as one-layer, two-layer or multi-layer volume closed or unclosed forms, and different faces of one modular element can have the same or different number of layers.

The means for connecting the modular elements together are arranged in the same or different manner on the different sides of the flat modular elements or on the different faces of the volume modular elements.

The similarly shaped modular elements are of the same or different linear dimensions.

The modular elements are of the same color, or different colors or color combinations. The flat closed two-layer and multi-layer modular elements, the closed volume one-layer and multi-layer hollow modular elements, and unclosed volume two-layer and multi-layer modular elements can comprise a filler inside one or several cavities, with an amount of the filler allowing for the spatial transformation of the modular element, and the filler representing plastic balls, padding polyester, cotton batting, groats, sawings or other filler having suitable properties, or the combination thereof. The modular elements are demontable—for example, two halves of the two-layer closed flat modular element equipped with the fixing means as Velcro fasteners can be connected by using lacing or a zipper rather than tied to each other along a contour. The set of the modular elements are accompanied by additional modular elements made as decorative components, accessories, stylized parts of a human or animal body or face, for example, eyes, noses, mouths, the additional modular elements being equipped with connecting means compatible with all or only some of the connecting means arranged on the surface of the modular elements of the construction kit. The set of the modular elements consists of similarly or differently designed modular elements equipped with compliable fixing means—for example, the set of the modular elements can consist of elements having a different number of layers, different dimensions, geometry and color, made of different materials, and using different combinations of the fixing means and the different arrangements thereof.

The drawback of the above-described fastener is a low-reliable connection of the modular elements of the construction kit, with the modular elements being not capable of rotating by 360° when forming different spatial figures.

SUMMARY

The technical result of the invention is an increase in the reliability of the connection of modular elements of a construction kit, while providing the possibility for each of the modular elements to rotate by 360° when forming different spatial figures, as well as design simplification.

The technical result is provided by a connecting element of a toy construction kit due to the fact that the connecting element consists of a receiving part and a removable part which, when brought together, fasten together under an effect of magnetic forces such as to be disconnectable and rotatable about a coupling point by 360°. Each of these parts consists of a collar and a neodymium magnet fastened together, the neodymium magnet being made as a truncated cone-shaped collar. A diameter of each disc is smaller than a diameter of each collar, and each collar with a through hole has an outer skirt with holes for its attachment to an element of the toy construction kit. The receiving part has a disk, a collar having a through hole in which the neodymium magnet with a through hole is attached with a positive polarity inward, and in the removable part—with a negative polarity inward, the inward polarities therefor attracting each other. The removable part has a disk with a through hole, a metal rod, said rod flaring to a head at one end and passing through the through holes of the disc, the collar, the neodymium magnet, to protrude on the neodymium magnet side, and a diameter of the head of the metal rod is larger than a diameter of the through hole of the neodymium magnet.

The increase in the reliability of the connection of the modular elements of the construction kit, while providing the possibility for each of the modular elements to rotate by 360° when forming different spatial figures, is provided by design simplification due to the fact that the connecting element of the toy construction kit consists of the receiving part and the removable part which, when brought together, fasten together under the effect of magnetic forces such as to be disconnectable and rotatable about the coupling point by 360°. The receiving and removable parts consist of simple structural elements. The receiving part consists of the disk, the collar and the neodymium magnet fastened together, the neodymium magnet being made as a truncated cone-shaped collar. The diameter of the disk is smaller than the diameter of the collar. The neodymium magnet made as the truncated cone-shaped collar is attached inside the collar with its positive polarity inward. The removable part consists of the disc having the through hole, the collar, the neodymium magnet and the metal rod which are all fastened together, with the through hole, the collar and the neodymium magnet being different in diameter. The neodymium magnet made as the truncated cone-shaped collar is attached inside the collar with its negative polarity inward, with such a shape providing the reliability of the connection of the neodymium magnet with the collar without failing.

The disk having the through hole is attached to the collar on one side, with the metal rod flaring to the head at one end being inserted in the through holes of the collar and the disc. Passing through the through holes of the disk, the collar and the neodymium magnet, the metal rod protrudes on the magnet side. The diameter of the head of the metal rod is larger than the diameter of the through hole of the neodymium magnet. The diameter of the disk having the through hole is smaller than the diameter of the collar. Each collar of the receiving and removable parts has an outer skirt with holes for its attachment to an element of the toy construction kit. The metal rod of the removable part, which is inserted in the through hole of the neodymium magnet of the receiving part, prevents the receiving and removable parts from sliding relative to each other and increases an attachment area of the magnets.

The connecting element of the toy construction kit can be inserted in any toy.

The presence of essential features, which are different from those peculiar to the prior art, allows the invention to be considered novel.

The possibility to implement the invention in industry allows the invention to be considered meeting the patentability requirement of industrial applicability.

BRIEF DESCRIPTION OF THE DRAWINGS

The essence of the invention is disclosed in the drawings, in which.

PREFERRED EMBODIMENT OF THE INVENTION

Figure 1:
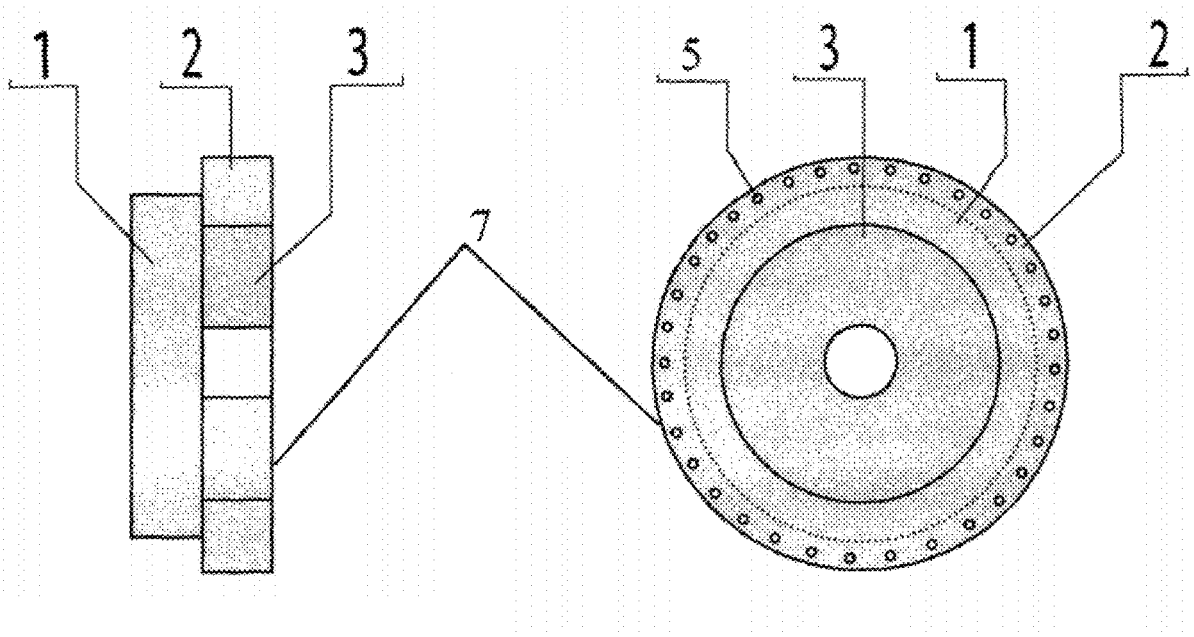
FIG. 1 shows a receiving part neodymium magnet disk assembly.
Figure 2:
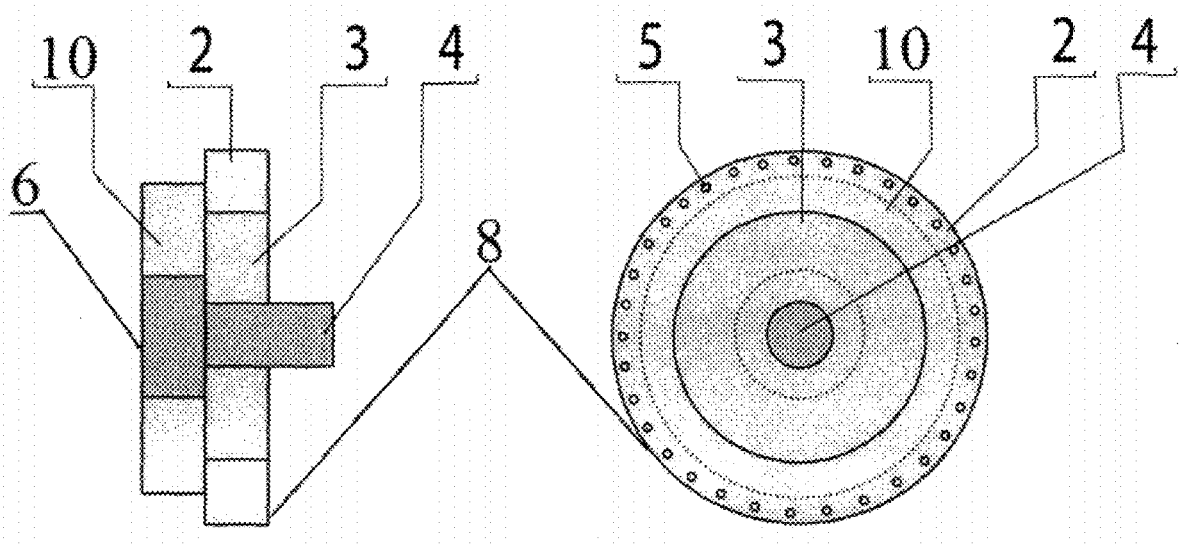
FIG. 2 shows a removable part neodymium magnet disk assembly.
Figure 3:
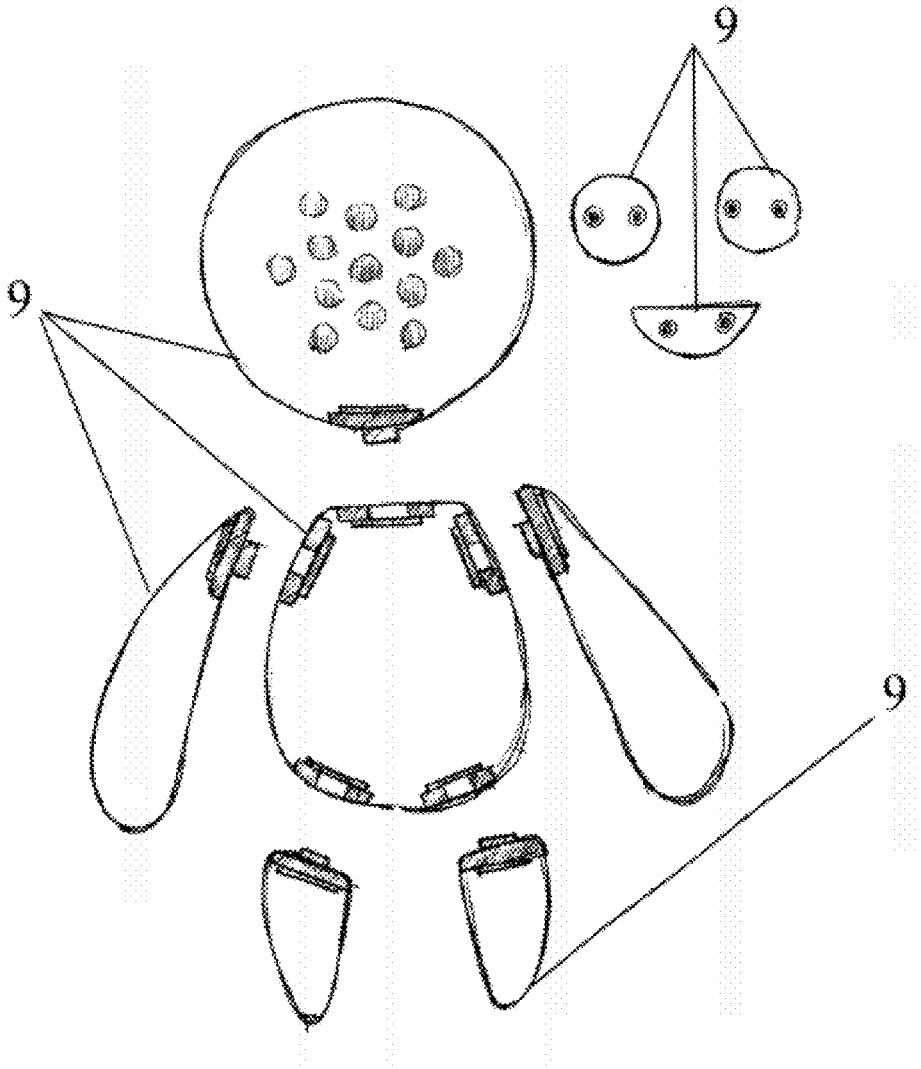
FIG. 3 shows elements of a toy construction kit.

A connecting element of a toy construction kit consists of a receiving part 7 and a removable part 8, which, when brought together, fasten together under an effect of magnetic forces such as to be disconnectable and rotatable about a coupling point by 360°.

The receiving part 7 consists of a disk 1, a collar 2, and a neodymium magnet 3 which are different in diameter and fastened together, with the neodymium magnet 3 being made as a truncated cone-shaped collar. The diameter of the disk 1 is smaller than the diameter of the collar 2. The neodymium magnet 3 made as the truncated cone-shaped collar is attached inside the collar 2 with its positive polarity inward.

The removable part 8 consists of a disk 10 having a through hole 11, defining a center axis of the disk 12, a collar 2, a neodymium magnet 3 and a metal rod 4 which are fastened together, with the disk 10, the collar 2, and the neodymium magnet 3 being different in diameter, and the neodymium magnet 3 being made as the truncated cone-shaped collar. The neodymium magnet 3 made as the truncated cone-shaped collar is attached inside the collar 2 with its negative polarity inward. The disk 10 having the through hole is attached to the collar 2 on one side, with the metal rod 4 flaring to the head at one end being inserted in the through holes of the collar 2 and the disc 10. Passing through the through holes of the disk 10, the collar 2 and the neodymium magnet 3, the metal rod 4 protrudes on a proximal side 13 of the neodymium magnet 3. The diameter of the head 6 of the metal rod 4 is larger than the diameter of the through hole of the neodymium magnet 3. The diameter of the disk 10 having the through hole is smaller than the diameter of the collar 2.

Each collar 2 of the receiving 7 and removable 8 parts has an outer skirt with holes 5 for its attachment to an element 9 of the toy construction kit.

When brought together, the receiving 7 and removable 8 parts are attached to each other under the effect of magnetic forces such as to be disconnectable and rotatable about the coupling point by 360°. The metal rod 4 in the removable part 8 attached to the receiving part 7 prevents the elements of the toy construction kit from sliding relative to each other and increases an attachment area of the neodymium magnets 3.

The elements 9 of the toy construction kit can be made as a head, body, hands and legs of a toy, and can be different in size, shape and color.

OPERATION OF THE INVENTION

The connecting element of the toy construction kit is used as follows. For example, there are the following elements of the toy construction kit 9: a head, a body, hands and legs.

The receiving part 7 is attached to the element-body by means of a thread and the holes 5 on the outer skirt of the collar 2. The removable part 8 is attached to each of the element-head, element-hand, and element-leg.

The elements 9 of the toy construction kit—i.e. the head, hands and legs, —are all attached to the element-body as follows.

The metal rod 4 of the removable part 8, which protrudes on the side of the neodymium magnet 3, is inserted in the through hole of the neodymium magnet 3 of the receiving part 7. When brought together, the elements 9 of the toy construction kit—i.e. the head, body, hands and legs, —are all reliably attached to each other under the effect of magnetic forces such as to be disconnectable and rotatable about the coupling point by 360°.

What is claimed is:

1. A connecting element of a toy construction kit, comprising:

a receiving part and a removable part magnetically coupled by a first neodymium magnet disk assembly and a second neodymium magnet disk assembly, the disk assemblies disposed within a connecting portion of the receiving and removable parts;

a through hole disposed through the first and the second neodymium magnet disk assemblies defining a center axis of the first and the second neodymium magnet disk assemblies;

the neodymium magnet disk assembly, when coplanar and coaxially coupled, rotatable about the respective center axes by 360°;

the first coplanar neodymium magnetic disk assembly having a first collar portion coupled to a first neodymium magnet portion, the first neodymium magnet portion substantially shaped as a truncated cone-shaped collar, a diameter of the first magnetic disk assembly being smaller than a diameter of the first collar, and the through hole of the first neodymium magnet assembly disposed through the first collar and the neodymium magnet portion, wherein above the first collar a disk is attached for holding a first neodymium magnetic ring inside the first collar, the first collar having an outer skirt member with a plurality of holes adapted to facilitate attachment to the receiving parts, the receiving parts having a positive polarity inward; and the second coplanar neodymium magnet disk assembly having a second collar portion coupled to a second neodymium magnet, a diameter of the second magnetic disk assembly being smaller than diameter of the second collar, and the through hole being aligned for the second neodymium magnet assembly disposed through the second collar and the second neodymium magnet portion, wherein above the second collar is attached a washer for holding a second neodymium magnetic ring inside the second collar, a metal rod member disposed through the through hole and protruding at a proximal surface of the second neodymium magnet disk assembly, the metal rod member with an extension in a form of a head at a tip adapted to be disposed at least partially within the through hole of the opposing first neodymium magnet assembly when the opposing magnet assembly is in a coupled state with, the second collar having an outer skirt with a plurality of holes adapted to facilitate attachment to the removable part, the removable part having a negative polarity inward.

* * * * *